US006892480B1

(12) United States Patent
Gledhill et al.

(10) Patent No.: US 6,892,480 B1
(45) Date of Patent: May 17, 2005

(54) LOAD RELIEVER FOR PLOW MOLDBOARD

(75) Inventors: Garland Gledhill, Galion, OH (US); James Springer, New Washington, OH (US)

(73) Assignee: The Gledhill Road Machinery Company, Inc., Galion, OH (US)

( * ) Notice: Subject to any disclaimer, the term of this patent is extended or adjusted under 35 U.S.C. 154(b) by 0 days.

(21) Appl. No.: 10/354,766

(22) Filed: Jan. 30, 2003

Related U.S. Application Data

(60) Provisional application No. 60/355,414, filed on Feb. 7, 2002.

(51) Int. Cl.[7] ..... E01H 5/06
(52) U.S. Cl. ..... 37/232; 37/266
(58) Field of Search ..... 37/232, 231, 266; 267/72, 71

(56) References Cited

U.S. PATENT DOCUMENTS 211,710 A * 1/1879 Dabus ..... 267/72
1,609,353 A * 12/1926 Heflin ..... 267/72
4,976,054 A 12/1990 Jones
5,482,258 A * 1/1996 Clauson et al. ..... 267/71
5,778,567 A 7/1998 Jager et al.
6,088,937 A * 7/2000 DiClementi et al. ..... 37/232
6,484,421 B1 11/2002 Donoghue
6,526,677 B1 * 3/2003 Bloxdorf et al. ..... 37/231

* cited by examiner

*Primary Examiner*—Meredith Petravick
(74) *Attorney, Agent, or Firm*—Craig A. Fieschko, Esq.; DeWitt Ross & Stevens S.C.

(57) ABSTRACT

The invention alleviates wear on a plow moldboard by achieving a reduction in the effective weight of the moldboard on the roadway. One or more elastic links are interposed between the moldboard and the lifting arm which elevates and lowers the moldboard. The elastic links may be tensioned to such a degree that they serve as a counterweight for the moldboard, transmitting all or most of its weight to the lift arm and the plowing vehicle. The effective weight of the moldboard is thus reduced to such a degree that the lower edge of the moldboard bears against the roadway with little or no force, and it skids or slides along the roadway rather than grinding against it.

19 Claims, 2 Drawing Sheets

LOAD RELIEVER FOR PLOW MOLDBOARD

CROSS-REFERENCE TO RELATED APPLICATIONS

This application claims priority under 35 USC §119(e) to U.S. Provisional Patent Application 60/355,414 filed 7 Feb. 2002, the entirety of which is incorporated by reference herein.

FIELD OF THE INVENTION

This document concerns an invention relating generally to methods and apparata for enhancing the performance and lifespan of snowplow moldboards (i.e., snowplow "plowing blades") and components thereof, and more specifically to methods and apparata for supporting snowplow moldboards and associated snowplow components upon or above the plowing surface during plowing operations.

BACKGROUND OF THE INVENTION

Snowplows generally have plow blades which include a moldboard and a trip board. A trip board is a plowing blade pivotally attached beneath the lower edge of a moldboard, and a torsion spring or other biasing device is situated between the moldboard and the trip board to maintain the trip board in a generally coplanar relationship (or other desired relationship) with the moldboard. When the trip board strikes an unyielding obstruction on the roadway (or other surface to be plowed) during plowing, the biasing device surrenders to allow the trip board to pivot backwardly so that the obstruction may pass beneath the trip board. When the plow blade passes over the obstruction, the trip board then pivots back to its original position. The trip board thus eliminates stress and impact damage to a moldboard of a plow blade by giving way when an obstruction is encountered.

The plow blade (moldboard and trip board) is generally affixed to a reversing table which is in turn (usually) pivotally affixed to a mounting frame. The mounting frame is then removably attached to the plowing vehicle. As the vehicle travels forward, the plow blade may be directed to the right and left via the reversing table pivoting on the mounting frame. A lift arm, which is generally powered by a hydraulic cylinder, is also affixed to the front of the motor vehicle. One or more lifting chains or cables descend from the lift arm to the reversing table. When the lift arm is pivoted upwards, the mounting frame, reversing table and moldboard are all raised upwards, which can allow the plowing vehicle to move forward without having the trip board scrape along the roadway.

In most plows, when the lift arm is fully lowered, the lifting chains/cables are slack and the trip board has its lower edge resting on the ground, with the full weight of the moldboard (and of portions of the reversing table and mounting frame) atop it. The plow is then operated with the moldboard in this state, which cases rapid wear on the trip board. Some plow operators take the time to raise the lift arms to a sufficient degree that the lower edge of the moldboard rides at or very near ground level, but the moldboard is still subject to shock and wear owing to irregularities in the road surface, and owing to the raising and lowering of the moldboard as the plowing vehicle encounters changes in the grade of the road.

DETAILED DESCRIPTION OF PREFERRED EMBODIMENTS OF THE INVENTION

The invention involves a plow moldboard load relieving apparatus for effectively reducing the weight of a plow moldboard and associated components atop a trip board (or atop the lower edge of a moldboard, where a trip board is not present). The claims set forth at the end of this document define the various versions of the invention in which exclusive rights are secured. To provide the reader with a better understanding of some of the advantageous features of the invention, some preferred features will now be described in greater detail.

Figure 1:
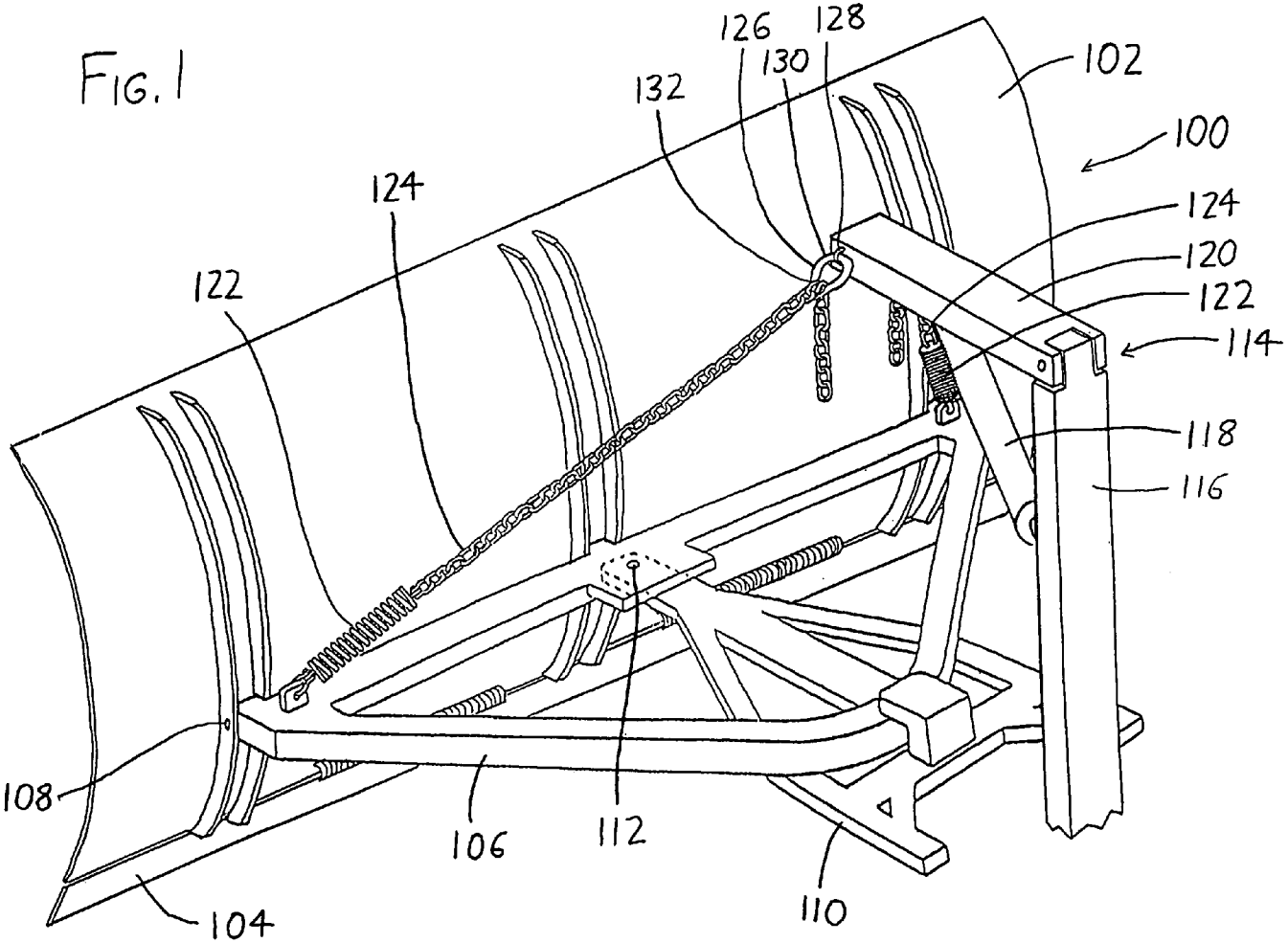
FIG. 1 is a perspective view of an exemplary moldboard assembly 100 (a reversing table 106 with its moldboard 102, plus an associated tripboard 104, if one is present) which is lifted via lift arm 120 (shown only partially in FIG. 1), and wherein the moldboard assembly 100 is supported by an exemplary version of the invention which includes elastic links 122 interposed between the moldboard assembly 100 and the lift arm 120, with the elastic links 122 being adjustably tensioned by adjusting the effective lengths of tethers 124 at pear link 126.

An exemplary version of the plow moldboard load relieving apparatus is shown in FIG. 1. A plow moldboard assembly 100 includes a moldboard 102, a lower tripboard 104 pivotally affixed to the lower length of the moldboard 102, and a reversing table 106 to which the moldboard 102 is pivotally mounted at pivots 108 to allow adjustment of the vertical angle of the moldboard 102 with respect to the surface being plowed. The moldboard assembly 100, more particularly its reversing table 106, is then pivotally mounted to a mounting frame 110 at pivot 112 to allow the moldboard assembly 100 (and all of its moldboard 102, tripboard 104, and reversing table 106) to be steered/oriented rightwardly or leftwardly. The mounting frame 110 is itself affixed to a plowing vehicle (not shown), or to structures extending from the plowing vehicle. The reader should note that for sake of clarity, some common structure of standard moldboard assemblies 100 is not shown, e.g., there are no hydraulic cylinders or other actuators depicted between the moldboard 102 and the reversing table 106 (or other structure) to allow pivoting of the moldboard 102 about the pivots 108. Additionally, moldboards 102, reversing tables 106, and mounting frames 110 are available in a wide variety of sizes and configurations apart from those shown, and the invention can accommodate almost any sizes and configurations known (or yet to be developed).

A lift 114 also extends from the plowing vehicle (or associated structure) to extend adjacent to the moldboard 102. The lift 114 includes a stanchion 116 with a hydraulic cylinder 118 (or other actuator) extending therefrom to a lift arm 120 pivotally affixed to the stanchion 116, thereby allowing the lift arm 120 to be actuated upwardly or downwardly with respect to the stanchion 116.

The foregoing structure is relatively customary, and it is then customary to extend a chain between the lift arm 120 and the moldboard assembly 100 (more specifically, to its moldboard 102 and/or reversing table 106) to allow the lifting of the moldboard assembly 100 when the lift arm 120 is lifted; see, e.g., U.S. Pat. No. 4,976,054 to Jones. However, unless the operator of the plowing vehicle lifts the lift arm 120 to such an extent that the lower edge of the moldboard 102 (or its tripboard 104, if one is present) is at or just above ground level, the lower edge will grind against the surface being plowed, causing relatively rapid wear. Additionally, the problem is not easily alleviated by elevating the lower edge of the moldboard 102 (or its tripboard 104) to a height just above the ground (e.g., 1–5 cm above the ground): when changes in road grade are encountered, such as bumps or dips, the lower edge will transmit extreme shock to the moldboard assembly 100 when it strikes the roadway, and may "skip" over the pavement. Thus, to avoid this shock, it is generally preferable to simply have the lower edge grind over the roadway, despite the rapid wear involved.

The invention alleviates both wear and shock by achieving a reduction in the effective weight of the moldboard 102 (or its tripboard 104, if one is present) on the roadway. An elastic link 122 is interposed between the lift arm 120 and the moldboard assembly 100, or more preferably, two or more elastic links 122 are interposed between the lift arm and points distributed about the width of the moldboard assembly 100 (as depicted in FIG. 1). While the elastic links 122 are depicted as being affixed to the reversing table 106, it should be understood that they could alternatively or additionally be anchored (i.e., directly or indirectly affixed) to the moldboard 102. As will be discussed at greater length below, the elastic links 122—which are elastically expandable over a limited distance—may be tensioned to such a degree that they serve as a counterweight for the moldboard assembly 100, transmitting all or most of its weight to the lift arm 120 and the plowing vehicle. In this manner, the effective weight of the moldboard assembly 100 is reduced to such a degree that the lower edge of the moldboard 102 (or its tripboard 104, if one is present) bears against the surface being plowed with little or no force. The lower edge of the moldboard 102 therefore skids or slides along the plowing surface, rather than grinding against it (as would be the case if the moldboard assembly 100 was not counterweighted by the invention), and the moldboard 102 will not wear so rapidly.

While the elastic links 122 could be installed in the place of the chains, cables, or other tethers extending between the lift arm 120 and the moldboard assembly 100, the elastic links 122 are instead preferably affixed in conjunction with such tethers. In the exemplary version of the invention depicted in FIG. 1, the elastic links 122 are affixed to tethers (chains) 124 extending from the lift arm 120, such that the elastic links 122 rest between the chains 124 and the moldboard assembly 100. Alternative arrangements could have the elastic links 122 each affixed directly to the lift arm 120 with a chain 124 or other tether extending therefrom and anchoring each elastic link 122 to the moldboard assembly 100, or chains 124 or other tethers could extend from both sides of the elastic links 122 to both the lift arm 120 and the moldboard assembly 100. As will be discussed below, it is useful to extend a chain 124 or other tether along with an elastic link 122 between the lift arm 120 and the moldboard assembly 100 because the tether 124 may assist in appropriately tensioning the elastic link 122 for the desired degree of "float": if the tether 124 is affixable at selected locations along its length to the moldboard assembly 100, lift arm 120, and/or the elastic link 122, the effective length of the tether 124 between the elastic link 122 and the lift arm 120 (or the elastic link 122 and the moldboard assembly 100) may be adjusted as desired to apply the desired degree of tension to the elastic link 122.

The tether 124 depicted in FIG. 1 is a standard chain having multiple links extending from the elastic link 122 to a pear link 126 fit within a loop 128 on the lift arm 120. The pear link 126 has such a name because it is a loop-like link having a large diameter portion 130 and a narrow diameter portion 132, and thus the interior borders of the pear link 126 follow a path shaped similarly to the silhouette of a pear. When an appropriately-sized pear link 126 is used in conjunction with an appropriately-sized chain 124, a selected link of the chain 124 may be fit into the large diameter portion 130 and then in turn be inserted into the narrow diameter portion 132 of the pear link 126, wherein the thickness of the selected link is closely received. Afterward, the selected link cannot be dislodged (unless lifted into the large diameter portion 130) because its adjacent links, being oriented at different angles than the selected link, cannot slide through the narrow diameter portion 132 of the pear link 126 without interference.

As a result, the effective length of the chain 124 between the elastic link 122 and the lift arm 120 may be varied by simply selecting a desired link of the chain 124 to fit within the pear link 126. Once the chain 124 between the elastic link 122 and the lift arm 120 is drawn taut, the elastic link 122 begins to be tensioned in such a manner that its length between the chain 124 and the moldboard assembly 100 increases, and the elastic link 122 then begins to exert an upward pulling force on the moldboard assembly 100, towards the lift arm 120. The effective weight of the moldboard assembly 100 upon the plowing surface is thereby decreased. Since the chain 124 is affixable to the pear link 126 (and thus to the lift arm 120) at user-selected locations along its length, the effective length of the chain 124 between the lift arm 120 and the elastic link 122 is adjustably varied as desired, and thus the chain's associated elastic link 122 may be adjustably tensioned by a user as desired.

Figure 2:
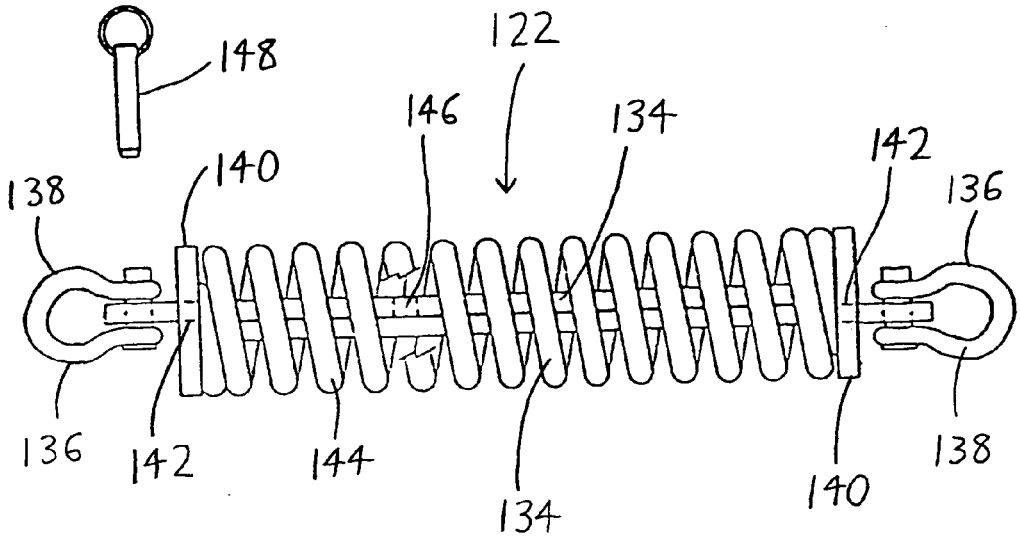
FIG. 2 is a top elevational view, shown partially cut away, of the elastic link 122 of FIG. 1.

It is then useful to refer to FIG. 2 and review the structure of the preferred elastic links 122 in greater detail. As noted above, the elastic links 122 are elastically expandable so that they may be placed in tension (and so that they may communicate this tension to the structures to which they are attached). Additionally, they are preferably expandable over a limited distance, i.e., they are prevented from extending to such a length that they lose structural integrity or otherwise fail (as might be the case, for example, where a standard helical spring is attached at its ends to serve as an elastic link 122: if extended too far, the spring will uncoil, losing its elastic properties and effectively failing). A preferred elastic link 122, as depicted in FIG. 2, includes elongated first and second extension members 134. Since these first and second extension members 134 are substantially structurally identical in the exemplary elastic link 122 illustrated in FIG. 2, identical or substantially similar components shared by both of the extension members 134 will be labeled with identical reference numerals (though it should be understood that the elastic links 122 need not necessarily be constructed of collections of identical or similar components). Each extension member 134 has an attachment end 136 having a pivotally affixed attachment loop 138 adapted for anchoring to surrounding plow structure. In FIG. 1, such surrounding plow structure is the reversing table 106 of the moldboard assembly 100, and also the lift arm 120, to which an attachment end 136 is anchored via a tether 124. Opposite the attachment end 136, each extension member 134 has an opposing biasing end 140 having an extension aperture 142 defined therein. The first and second extension members 134 are adjacently situated in close parallel relationship so that each extension member 134 extends through the extension aperture 142 in the biasing end 140 of the other extension member 134. As a result, the attachment ends 136 of the extension members 134 protrude in opposing directions at opposing ends of each elastic link 122, and the extension members 134 are restrained to move in parallel relation to each other so that the attachment ends 136 are adjustably spaceable. When the attachment ends 136 are placed in tension (pulled away from each other), the extension members 134 slide in relation to each other so that their biasing ends 140 approach each other.

A spring 144 is then situated between the biasing ends 140 of the extension members 134 (and between the attachment ends 136 of the extension members 134 as well) so that when the attachment ends 136 of an elastic link 122 are tensioned (i.e., the elastic link 122 is elastically extended), the spring 144 is compressed. This arrangement inherently only allows expansion of an elastic link 122 by a limited distance, since each elastic link 122 can only be expanded to the same extent that a spring 144 can be compressed. As a result, each elastic link 122 has an effective maximum extension length, and it is extremely difficult to extend an elastic link 122 to the point of failure.

For reasons to be discussed later, it is useful to be able to lock an elastic link 122 into a tensioned state (i.e., so that the spring 144 is in a compressed state). This is preferably done by providing a locking member which is adjustably affixable to at least one of the extension members 134 at one or more locking locations between its attachment end 136 and its biasing end 140, such that when the elastic link 122 is extended, the locking member can be fit on the exposed portion of one extension member 134 (and adjacent the biasing end 140 of the other extension member 134). At least one of the extension members 134 within each elastic link 122 has one or more locking apertures 146 situated between its attachment end 136 and its biasing end 140. While the locking apertures 146 are ordinarily situated within the spring 144 and between the biasing ends 140 of the extension members 134, when the elastic links 122 are tensioned (the springs 144 are compressed) so that each extension member 134 extends sufficiently from the extension aperture 142 of its adjacent extension member 134, the locking apertures 146 will no longer rest between the biasing ends 140 and will be exposed adjacent one of the attachment ends 136 of the elastic link 122. Once exposed in this manner, a locking pin 148 may be inserted into a selected locking aperture 146. If the tension on the elastic links 122 is then released, the spring 144 will expand to the extent that the locking pin 148 encounters the biasing end 140 of the extension member 134 wherein it is not inserted. Since the biasing end 140 of this extension member 134 can extend no further towards the attachment end 136 of the other extension member 134 owing to interference with the locking pin 148, the spring 144 will be locked in compression by the locking pin 148.

When implementing the invention, it is useful to appropriately tension the elastic links 122 to such a degree so that the moldboard assembly 100 has the desired effective weight (i.e., so that the effective weight of the moldboard assembly 100 atop the plowing surface is reduced to the desired degree). In the version of the invention depicted in FIGS. 1 and 2, this is preferably done as follows:

(1) The lift arm 120 is fully lowered so that the lower edge of the moldboard 102 (or the tripboard 104, if one is present) rests on the ground. The chains 124 are shortened (by inserting an appropriate link of each chain 124 within the narrow diameter portion 132 of its respective pear link 126) so that the chains 124 and elastic links 122 have no slack.

(2) The lift arm 120 is fully lifted so that the lower edge of the moldboard 102 (or the tripboard 104, if one is present) is clear of the ground. This will tension the elastic links 122 and cause them to extend, exposing their locking apertures 146. Locking pins 148 may then be inserted in whichever locking apertures 146 that best secure the elastic links 122 into their presently extended state.

(3) The lift arm 120 is fully lowered so that the lower edge of the moldboard 102 (or the tripboard 104, if one is present) rests on the ground, introducing slack back into the chains 124 and their elastic links 122. The chains 124 are shortened (by inserting an appropriate link within the narrow diameter portion 132 of the pear link 126) so that the chains 124 and elastic links 122 have no slack.

(4) The lift arm 120 is lifted sufficiently to situate the lower edge of the moldboard 102 (or the tripboard 104, if one is present) above the ground. This should retension the elastic links 122 enough to allow removal of the locking pins 148.

Once the locking pins 148 are removed, the plow assembly 100 is counterbalanced and ready for use. So long as the lift arm 120 is slightly lifted, the moldboard assembly 100 should be counterbalanced such that the moldboard 102 (or the tripboard 104, if one is present) should ride with little or no weight resting on the plowing surface, and the lower edge of the moldboard 102 (or the tripboard 104, if one is present) will not wear so rapidly.

If a higher effective weight of the moldboard assembly 100 is desired, the foregoing step (2) should be modified so that the locking pins 148 allow some retraction of the elastic links 122 (expansion of their springs 144) in step (3). For example, the elastic links 122 could be tensioned to carry 75% of the weight of the moldboard assembly 100 (with the remaining 25% bearing on the road). This would better allow the moldboard assembly 100 to follow the road if a dip is encountered, while still exerting less weight on the lower edge of the moldboard 102 (or the tripboard 104, if one is present).

The foregoing discussion focused on particularly preferred features of the invention, and should not be construed as meaning that the invention is limited to features which are precisely as described, since other features are considered to be within the scope of the invention as well. As a first example, the elastic links 122 may take forms other than the ones depicted in FIG. 1. The components of the elastic links 122 may be formed differently; for example, within an elastic link 122, one or both of the bar-like extension members 134 might be formed as a circular rod rather than as a plate-like bar. Alternatively, the elastic links 122 could have a structure quite different from the one shown in FIGS. 1 and 2, and might be simply provided as a helical spring, a pneumatic cylinder spring, an elastomeric block, or some other elastically tensionable structure. However, the elastic links 122 of FIGS. 1 and 2 are particularly preferred since they have a limited range of expansion/extension; they cannot overextend to the point of failure, as an ordinary spring having its ends affixed to tethers 124 might do; the springs 144 are prevented from bending or bowing; and the extension members 134 are easily attached to surrounding plow structure.

As another example, the tether 124 may take a wide variety of forms other than a chain. While the tether 124 is preferably a chain, cable, rope/cord, or other elongated and flexible member which allows adjustment of its effective length by affixing some selected location of the tether to surrounding structure (e.g., as by affixing a selected chain link to the pear link 126, or by tying down a selected portion of a cable, rope, or cord), the tether 124 could instead take the form of a rigid unitary member. For example, the chain 124 in FIG. 1 might be replaced by a threaded rod which engages threaded members on the elastic link 122 and the lift arm 120 (and/or the elastic link 122 and the moldboard assembly 100, if a tether 124 was desired therebetween), and which might be tensioned as desired by turning the threaded rod and/or the threaded members which it engages. As another example, the tether 124 might take the form of multiple elastic links 122 connected end to end, and having the same or different configurations and properties (such as spring constants and effective maximum lengths).

As a final example, it was noted above that the elastic links 122 (and/or their tethers 124) may be connected to different portions of the moldboard assembly 100; for example, rather than being affixed to the reversing table 106, they could instead (or additionally) be affixed to the moldboard 102 and/or tripboard 104. As an example, in some models of moldboards 102 (particularly those with tripboards 104), a rodlike spanner bar may be inserted in apertures extending across the width of the moldboard 102, and the elastic links 122 may then be connected to the ends of the spanner bar.

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. A plow moldboard load relieving apparatus comprising:

(1) an elastic link having:

a. an elongated first extension member having:

i. an attachment end adapted for anchoring to surrounding plow structure, ii. an opposing biasing end having an extension aperature defined therein;

b. an elongated second extension member having:

i. an attachment end adapted for anchoring to surrounding plow structure, ii. an opposing biasing end having an extension aperture defined therein;

wherein the first extension member extends through the extension aperture of the second extension member, and the second extension member extends through the extension aperture of the first extension member;

c. a spring extending between the biasing ends of the first and second extension members, whereby tension exerted on the attachment ends of the extension members compresses the spring;

(2) a moldboard assembly to which the attachment end of the second extension member is anchored, and (3) a lift arm to which the attachment end of the first extension member is anchored.

2. The plow moldboard load relieving apparatus of claim 1 wherein the first and second extension members are at least substantially structurally identical.

3. The plow moldboard load relieving apparatus of claim 1 further comprising a locking member which is adjustably affixable to at least one of the extension members at one or more locking locations along the extension member's length, the locking locations ordinarily resting between the biasing ends of the extension members unless the spring is compressed.

4. The plow moldboard load relieving apparatus of claim 1 further comprising a locking member removably affixed between the attachment end and the biasing end of one of the extension members.

5. The plow moldboard load relieving apparatus of claim 1 wherein at least one of the extension members has one or more locking apertures situated between its attachment end and its biasing end.

6. The plow moldboard load relieving apparatus of claim 1 wherein the elastic link is anchored to at least one of the moldboard assembly and the lift arm by a flexible elongated tether.

7. The plow moldboard load relieving apparatus of claim 1 wherein the elastic link is anchored to at least one of the moldboard assembly and the lift arm by a tether, the tether being selectively affixable to the moldboard assembly and/or the lift arm at selected locations along the length of the tether, whereby the length of the tether extending between the moldboard assembly and/or the lift arm may be selectively varied.

8. A plow moldboard load relieving apparatus comprising:

a. a moldboard assembly affixed to a plowing vehicle;

b. a lift arm affixed to the plowing vehicle;

c. an elastic link having first and second extension members, each extension member including:

i. an attachment end adapted for anchoring to surrounding plow structure, ii. an opposing biasing end, the first and second extension members being adjacently situated with their attachment ends protruding in opposing directions, and with:

(1) the attachment end of one of the extension members being anchored to the moldboard assembly, and (2) the attachment end of the other of the extension members being anchored to the lift arm;

d. a spring extending between the biasing ends of the first and second extension members and biasing them apart, whereby tension exerted on the attachment ends of the extension members compresses the spring.

9. The plow moldboard load relieving apparatus of claim 8 wherein the extension members are elongated, and are restrained to move in parallel relation.

10. The plow moldboard load relieving apparatus of claim 8 wherein each extension member extends through the biasing end of the other extension member.

11. The plow moldboard load relieving apparatus of claim 8 wherein at least one of the extension members may receive a locking member thereon to lock the spring in compression.

12. The plow moldboard load relieving apparatus of claim 8 wherein at least one of the attachment ends of the elastic link has an elongated tether extending therefrom, the tether anchoring the attachment end to the moldboard ably or to the lift arm.

13. The moldboard assembly load relieving apparatus of claim 12 wherein the length of each tether between the elastic link and the moldboard assembly or the lift arm may be selectively varied.

14. The moldboard assembly load relieving apparatus of claim 12 wherein at least one of the attachment ends of the elastic link has a chain extending therefrom, the chain having one or more links detachably affixed to the moldboard assembly or to the lift arm.

15. A moldboard assembly load relieving apparatus comprising:

a. a moldboard assembly;

b. a lift arm spaced from and extending adjacent to the moldboard assembly;

c. tethers extending from the lift arm towards the moldboard assembly, the tethers each being affixable to the lift arm at selected locations along their lengths;

d. elastic links, each elastic link:

(1) being anchored between one of the tethers and the moldboard assembly, and (2) being elastically extendible over a limited dista, wherein the lengths of the tethers between the lift arm and the elastic links may be varied to adjustably tension the elastic links.

16. The moldboard assembly load relieving apparatus of claim 15 wherein each elastic link includes a spring which is compressed when the elastic link is elastically extended.

17. The moldboard assembly load relieving apparatus of claim 15 wherein each elastic link may be locked into a compressed state.

18. The moldboard assembly load relieving apparatus of claim 15 wherein each elastic link has opposing attachment ends with adjustable spacing, and wherein the spring extends between the attachment ends.

19. The moldboard assembly load relieving apparatus of claim 18 wherein:

a. each elastic link is defined by a pair of elongated extension members, each of the extension members having a biasing end opposing one of the attachment ends, and b. the spring is maintained in compression between the biasing ends of the extension members.

* * * * *